US009307595B2

(12) United States Patent
Cho et al.

(10) Patent No.: US 9,307,595 B2
(45) Date of Patent: Apr. 5, 2016

(54) LIGHT EMITTING DEVICE DRIVING MODULE

(71) Applicant: LG Innotek Co., Ltd., Seoul (KR)

(72) Inventors: Weon Cho, Seoul (KR); Young Kuk Kwak, Seoul (KR); Yu Jin Hwang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/629,988

(22) Filed: Feb. 24, 2015

(65) Prior Publication Data

US 2015/0245437 A1 Aug. 27, 2015

(30) Foreign Application Priority Data

Feb. 25, 2014 (KR) ..... 10-2014-0022172

(51) Int. Cl.
*H05B 33/08* (2006.01)

(52) U.S. Cl.
CPC ..... *H05B 33/0827* (2013.01); *H05B 33/083* (2013.01); *H05B 33/0809* (2013.01); *H05B 33/0857* (2013.01); *H05B 33/0815* (2013.01)

(58) Field of Classification Search
USPC ..... 315/185 R, 185 S
See application file for complete search history.

(56) References Cited

U.S. PATENT DOCUMENTS

2011/0222277 A1* 9/2011 Negley et al. ..... 362/235
2012/0299484 A1 11/2012 Shin
2013/0221861 A1 8/2013 Creusen et al.
2013/0285564 A1* 10/2013 van de Ven et al. ..... 315/186
2014/0191648 A1* 7/2014 Lin ..... 313/116
2014/0300284 A1* 10/2014 Lee et al. ..... 315/186

FOREIGN PATENT DOCUMENTS

WO WO 2012/059838 A1 5/2012

* cited by examiner

*Primary Examiner* — Douglas W Owens
*Assistant Examiner* — Jonathan Cooper
(74) *Attorney, Agent, or Firm* — Birch, Stewart, Kolasch & Birch, LLP

(57) ABSTRACT

A light emitting device driving module may be provided that includes: a light emitter including a first light emitter and a second light emitter connected to the first light emitter; a rectifier which receives an AC power and outputs a rectified voltage; and a controller which receives the rectified voltage from the rectifier and controls on/offs of the first light emitter and the second light emitter in accordance with a magnitude of the rectified voltage. The light emitting device driving module according to the embodiment controls the on/offs of two or more kinds of the light emitting devices by using the AC power, and thus, drives the light emitting device in such a manner as to have a high color rendering index.

18 Claims, 9 Drawing Sheets

LIGHT EMITTING DEVICE DRIVING MODULE

CROSS-REFERENCE TO RELATED APPLICATION

The present application claims priority under 35 U.S.C. §119(a) of Korean Patent Application No. 10-2014-0022172 filed Feb. 25, 2014, the subject matters of which are incorporated herein by reference.

BACKGROUND

1. Field

This embodiment relates to a light emitting device driving module, and more particularly to a light emitting device driving module capable of implementing a high color rendering index.

2. Description of Related Art

A light emitting diode (LED) is a light source which is environmentally friendly and has a high efficiency, so that it has become popular. The LED is used in various fields, for example, display, optical communication, automobile and general lighting. Particularly, there has been increasing demand for a white light emitting diode creating white light.

In general, a correlation color temperature (CCT) and color rendering index (CRI) are used as a performance indicator for evaluating the characteristics of the white light. The white light is closer to sunlight (natural light) with the increase of the CRI. In particular, the CRI is used as an important indicator for evaluating the performance of the white light. The CRI represents how much the color of a thing is changed when the sunlight is irradiated to the thing and when an artificial light source (lighting, etc) is irradiated to the thing. The color of the thing is defined as 100 when the sunlight is irradiated to the thing. That is, the CRI represents how close the color of the thing to which the artificial light source is irradiated is to the color of the thing to which the sunlight is irradiated. The CRI is represented by a numerical value between 0 and 100. A conventional white light emitting diode has a low CRI.

Therefore, a try has been made to implement a high CRI by using a light emitting diode package (LED) phosphor. However, the conventional LED package has luminous efficiency degradation of 20% on average when the minimum CRI is set as 80. When the high CRI is implemented by using a normal white LED and red LED, a red LED package should be additionally configured and a separate power supply and control circuits are required for driving a red LED chip.

SUMMARY

The embodiment is to provide a light emitting device driving module having a high color rendering index by simultaneously controlling a white light emitting device and a red light emitting device.

The embodiment is to provide a light emitting device driving module having a small power loss by reducing a voltage gap between on and off of the light emitting device through use of a high voltage white light emitting device package and the red light emitting device.

One embodiment is a light emitting device driving module including: a light emitter comprising a first light emitter and a second light emitter connected to the first light emitter; a rectifier which receives an AC power and outputs a rectified voltage; and a controller which receives the rectified voltage from the rectifier and controls on/offs of the first light emitter and the second light emitter in accordance with a magnitude of the rectified voltage.

The first light emitter may be a red light emitter, and the second light emitter may be a white light emitter which is connected in series to the red light emitter.

The white light emitter may include one or more high voltage white light emitting device package. The one or more high voltage white light emitting device package may be independently and respectively controlled by the controller.

The controller may control the on/offs of the red light emitter and the white light emitter by comparing the rectified voltage with a threshold voltage of the light emitter.

When the rectified voltage is greater than the threshold voltage of the red light emitter, the controller may cause the red light emitter to be in an on-state. When the rectified voltage is greater than a sum of the threshold voltage of the red light emitter and the threshold voltage of a predetermined number of the high voltage white light emitting device packages, the controller may cause the predetermined number of the high voltage white light emitting device packages to be in an on-state.

The red light emitter may include one or more red light emitting devices. The one or more red light emitting devices may be connected in series to each other.

The one or more high voltage white light emitting device packages may be a first to a third high voltage white light emitting device packages. The first to the third high voltage white light emitting device packages may be connected in series to each other.

The controller may include a first switching unit which controls the on/off of the entire light emitter; and a second to a fourth switching units which control the on/offs of the first to the third high voltage white light emitting device packages respectively.

The first to the fourth switching units may include a bipolar junction transistor (BJT).

Another embodiment is a light emitting device driving module including: a rectifier which rectifies an AC power and outputs a rectified voltage; a first light emitter which receives the rectified voltage and comprises at least one first LED; a second light emitter which is directly connected to the first light emitter and comprises at least one second LED; and a controller which comprises a switching unit which is connected between the second light emitter and a ground (GND), is turned on by the rectified voltage, and electrically connects an anode of the second LED with the ground.

The first LED may be a colored LED which emits colored light, and the second LED may be a high voltage white LED package which emits white light.

The first LED may include any one of a red LED which has a light emitting peak wavelength of from 600 mm to 650 mm in a red region, a green LED which has a light emitting peak wavelength of from 520 mm to 570 mm in a green region, a blue LED which has a light emitting peak wavelength of from 430 mm to 490 mm in a blue region, and an amber LED which has a light emitting peak wavelength of from 570 mm to 620 mm in an amber region.

The high voltage white LED package may include a blue LED and a yellow phosphor.

The first LED may be connected in series to a plurality of red LEDs, and the second LED may be connected in series to a plurality of the high voltage white LED packages.

The switching unit may include a plurality of the switching units which connect the ground with the anode of each of the plurality of high voltage white LED packages.

The plurality of switching units may be turned on by the rectified voltage.

The plurality of high voltage white LED packages may include a first high voltage white LED package, a second high voltage white LED package, and a third high voltage white LED package. The plurality of switching units may include a first switching unit, a second switching unit, a third switching unit, and a fourth switching unit. The first to the fourth switching units may be bipolar junction transistors (BJT).

An emitter of the first switching unit may be connected to the ground, a base of the first switching unit may be connected to an end of a first resistance, and a collector of the first switching unit may be connected to an emitter of the second switching unit and a cathode of the first high voltage white LED package. A base of the second switching unit may be connected to an end of a second resistance and a collector of the second switching unit may be connected to an emitter of the third switching unit and the anode of the first high voltage white LED package. A base of the third switching unit may be connected to an end of a third resistance and a collector of the third switching unit may be connected to an emitter of the fourth switching unit and the anode of the second high voltage white LED package. A base of the fourth switching unit may be connected to an end of a fourth resistance and a collector of the fourth switching unit may be connected to the anode of the third high voltage white LED package. The other ends of the first to the fourth resistances may be connected to an output terminal of the rectifier.

The rectifier may be a bridge rectifier circuit.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
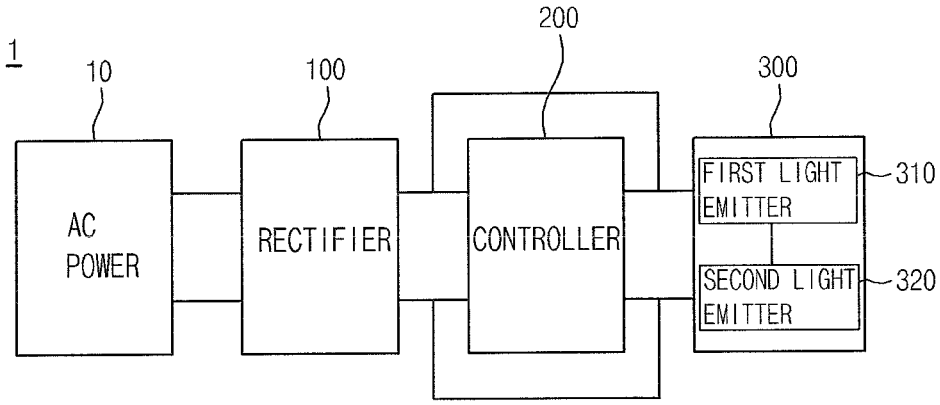
FIG. 1 is a block diagram of a light emitting device driving module according to an embodiment.
Figure 2:
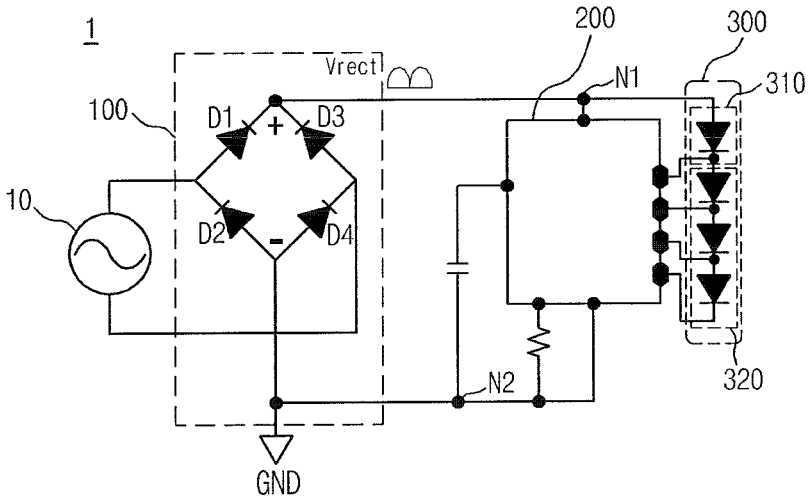
FIG. 2 is a brief circuit diagram of the light emitting device driving module according to the embodiment.

FIG. 1 is a block diagram of a light emitting device driving module according to an embodiment. FIG. 2 is a brief circuit diagram of the light emitting device driving module according to the embodiment.

Referring to FIGS. 1 and 2, a light emitting device driving module 1 according to the embodiment may include a rectifier 100, a controller 200, and a light emitter including a first light emitter 310 and a second light emitter 320.

As shown in FIGS. 1 and 2, the rectifier 100 receives and rectifies an AC power 10. The rectifier 100 may be implemented by a normal diode or an application device of the normal diode (e.g., a bridge rectifier circuit, etc.). Further, any device capable of rectifying the AC power 10 can be included in the rectifier 100 of the present invention.

The controller 200 receives a rectified voltage (Vrect) output from the rectifier 100 and selectively controls the on/offs of the plurality of light emitters 310 and 320 of the light emitter 300 in accordance with the magnitude of the received rectified voltage (Vrect). For example, the controller 200 may control the on/offs of the first light emitter 310 and second light emitter 320 of the light emitter 300 in accordance with the magnitude of the received rectified voltage (Vrect) in a predetermined order.

The light emitter 300 receives the rectified voltage (Vrect) output of the rectifier 100 and emits light according to the control of the controller 200.

The light emitter 300 may include the first light emitter 310 and the second light emitter 320.

The first light emitter 310 may emit colored lights other than white light. For example, in a white light emitting device which is implemented by using a blue light emitting device and a phosphor, the first light emitter 310 may be the red light emitter 310 which emits red light capable of compensating for a lack of color.

The second light emitter 320 may be the white light emitter 320 which emits white light.

The first light emitter 310 may be a red light emitter which has a light emitting peak wavelength of from 600 mm to 650 mm in a red region or may be a green light emitter which has a light emitting peak wavelength of from 520 mm to 570 mm in a green region or may be a blue light emitter which has a light emitting peak wavelength of from 430 mm to 490 mm in a blue region or may be an amber light emitter which has a light emitting peak wavelength of from 570 mm to 620 mm in an amber region.

The white light emitter 320 may be implemented by the light emitting peak wavelength of from 430 mm to 490 mm in a blue region and by the phosphor which is excited by the light emitting wavelength in a blue region and emits yellow light.

The colored light emitter may include various colors which can be implemented by the phosphor as well as the above-described red color. Representatively, a green color, a blue color an amber color, etc., may be included. However, there is no limit to this. In addition to the phosphor, the colored light emitter may include a color which can be implemented by changing the light emitting structure.

Figure 3A:
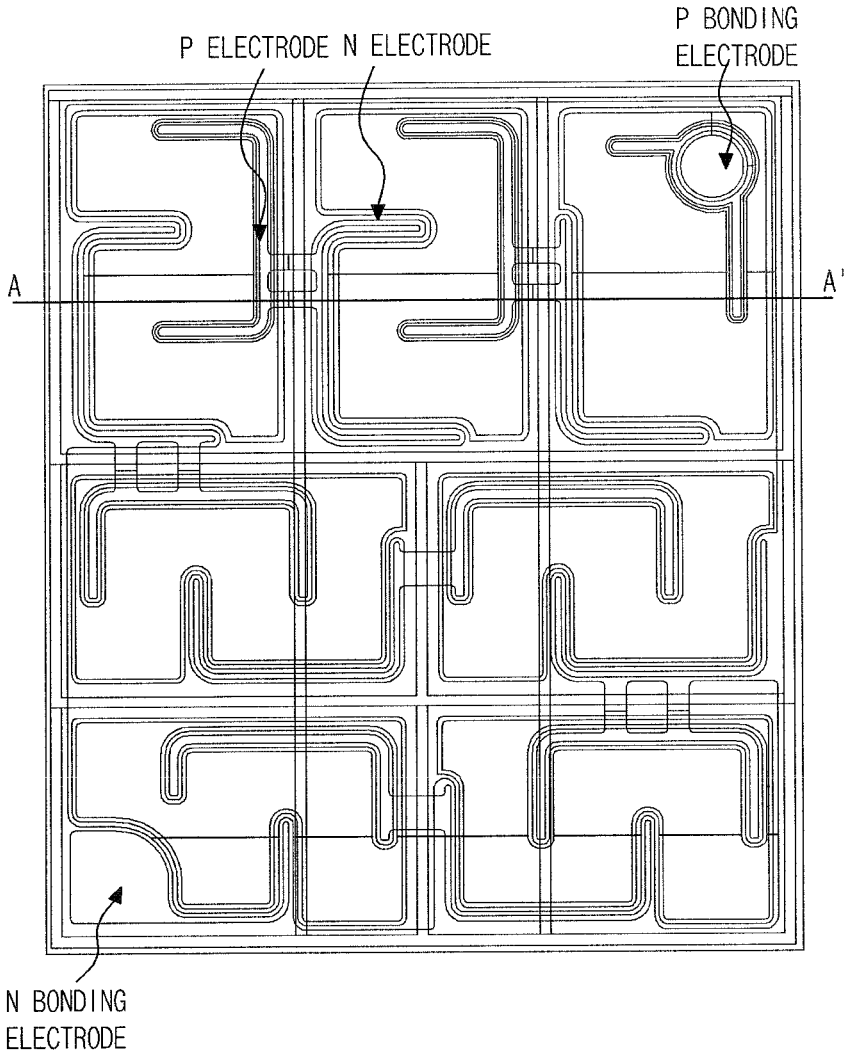
FIG. 3*a* is a brief view of a light emitting structure constituting a white light emitting device package in accordance with the embodiment.
Figure 3B:
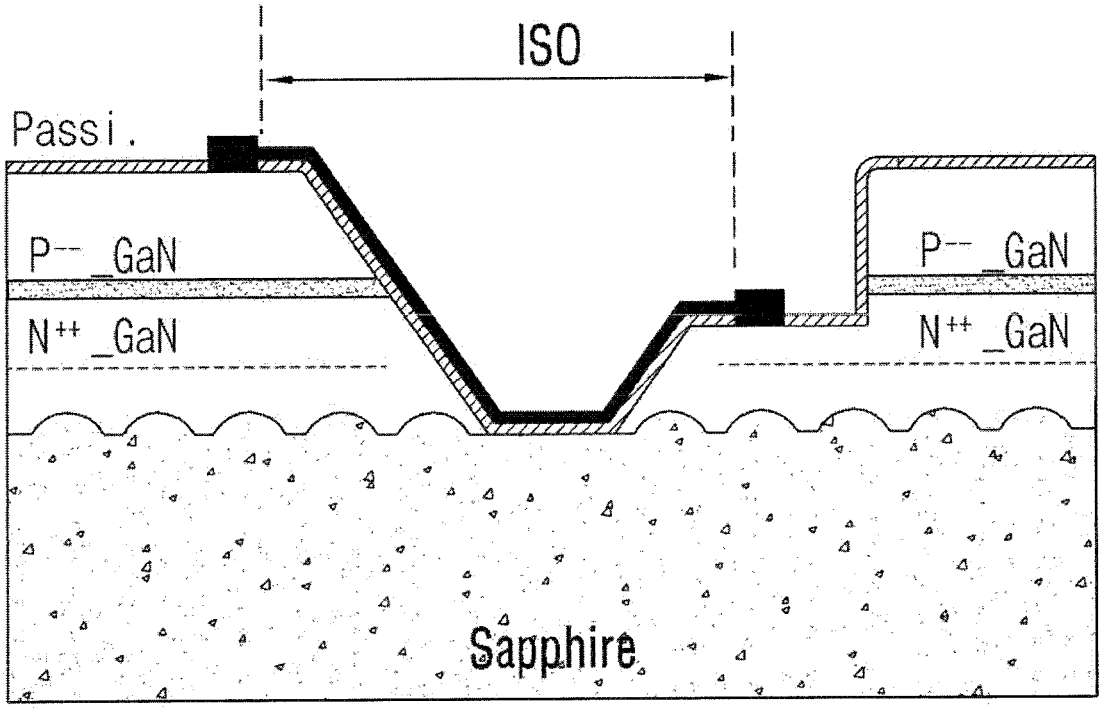
FIG. 3*b* is a cross sectional view taken along line A-A' of FIG. 3*a;*

FIG. 3*a* is a brief view of a light emitting structure constituting a white light emitting device package in accordance with the embodiment, and FIG. 3*b* is a cross sectional view taken along line A-A' of FIG. 3*a*.

According to the embodiment, the red light emitter 310 may include at least one colored light emitting device. When the red light emitter 310 includes the plurality of colored light emitting devices, red light emitting devices connected in series to or in parallel with each other may be included.

The white light emitter 320 may include at least one white light emitting device. When the white light emitter 320 includes the plurality of white light emitting devices, the white light emitting devices may be connected in series to or in parallel with each other.

The white light emitting device of the white light emitter 320 may be a light emitting device package including a chip in which the plurality of light emitting structures are connected in series to each other so as to be driven at a high voltage. As shown in FIGS. 3*a* and 3*b*, the light emitting structure may include an n-type semiconductor layer, a p-type semiconductor layer, and an active layer located between the n-type semiconductor layer and the p-type semiconductor layer. Specifically, the light emitting structure may be disposed on a substrate. The substrate may be a sapphire substrate ($Al_2O_3$).

The light emitting structure according to the embodiment may be formed on the sapphire growth substrate and may be GaN light emitting structure using a gallium-based light-emitting diode. The GaN light emitting structure may include an n-type GaN clad layer, an active layer and a p-type GaN clad layer. The n-type GaN clad layer is formed sequentially on the sapphire substrate. The active layer has a multi-quantum well structure. The GaN light emitting structure may be deposited by using a process like a metal organic chemical vapor deposition (MOCVD), etc.

Since a high voltage white light emitting device package can be used by controlling a voltage level without a separate AC-DC conversion after rectifying a commercial AC voltage, the high voltage white light emitting device package is advantageous for implementing a power circuit module for driving a light emitting device.

The red light emitter 310 may control the number of the light emitting devices in accordance with the brightness or an applied voltage of the high voltage white light emitting device package. Also, the red light emitter 310 may easily change the number of the red light emitting devices in accordance with the magnitude of the rectified voltage (Vrect) and the magnitude of the voltage applied to the white light emitter 320.

Also, the red light emitter 310 may respectively supply mutually different voltages and currents to a power supply which drives the white light emitter 320 and a power supply which drives the colored light emitter. Here, it is assumed that the number of the light emitting devices within the white light emitter 320 is Nw, the number of white light emitting structures within one light emitting device is nw, and the driving voltage of one white light emitting structure is Vw (Voltage white). Then, the driving voltage Vwt (Voltage white total) of the white light emitters 320 connected in series to each other would be Nw*nw*Vw. Likewise, it is assumed that the number of the light emitting devices within the red light emitter 310 is Nr, the number of red light emitting structures within one light emitting device is nr, and the driving voltage of one red light emitting structure is Vr (Voltage red). Then, the driving voltage Vrt (Voltage red total) of the red light emitters 310 would be Nr*nr*Vr.

Therefore, according to the embodiment, since the light emitter 300 includes the red light emitter 310 and the white light emitter 320, the light emitting device driving module 1 having a high color rendering index can be implemented. Also, when the red light emitting device and the white light emitting device instead of a light emitting device package phosphor are used as the red light emitter 310 and the white light emitter 320, luminous efficiency is not degraded. When a single power supply is used without using a separate power supply or control circuits for driving the red light emitting device, it is possible to simply configure the circuit of the light emitting device driving module 1 and to reduce the area of the chip.

Figure 4:
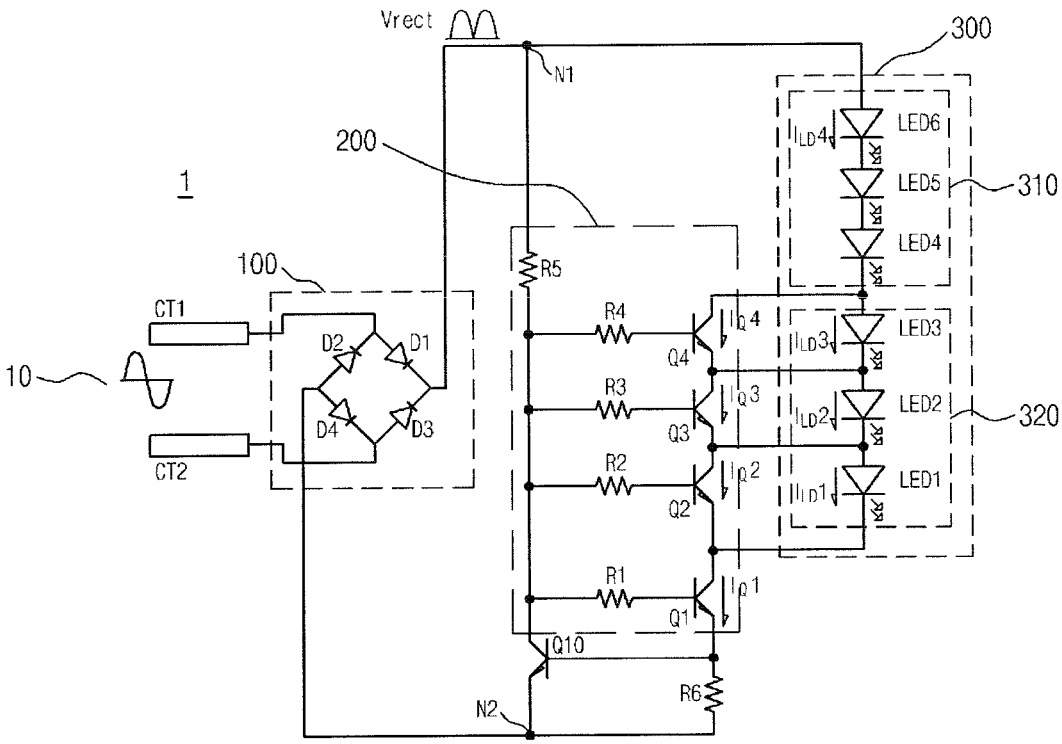
FIG. 4 is a circuit diagram of the light emitting device driving module according to the embodiment.

FIG. 4 is a circuit diagram of the light emitting device driving module according to the embodiment.

As shown in FIG. 4, the rectifier 100 according to the embodiment receives the AC power 10 through a first connection terminal CT1 and a second connection terminal CT2, and then rectifies the received AC power 10 and outputs the rectified voltage (Vrect). The rectifier 100 may have a bridge type using a first to a fourth diodes D1 to D4.

The rectified voltage (Vrect), i.e., the output of the rectifier 100 is transmitted to the controller 200 through a first node N1. The controller 200 receives the rectified voltage (Vrect) and controls the on/offs of the light emitting devices of the light emitter 300 in accordance with the magnitude of the rectified voltage (Vrect).

For this, the controller 200 may include a plurality of switching units which control the on/offs of the light emitting devices of the light emitter 300 in accordance with the magnitude of the rectified voltage (Vrect). In the embodiment, the controller 200 may include a first to a fourth switching units Q1 to Q4.

The first to the fourth switching units Q1 to Q4 may be implemented by a transistor for the purpose of a rapid response or may be a bipolar junction transistor (BJT) for the purpose of reducing the power consumption.

Resistances R1 to R4 may be connected to the bases of the switching units Q1 to Q4 respectively.

The emitter of the first switching unit Q1 may be connected to the ground resistance. The base of the first switching unit Q1 may be connected to the second base resistance R1. The collector of the first switching unit Q1 may be connected to the emitter of the second switching unit Q2 and the cathode of a first white light emitting device LED1.

The base of the second switching unit Q2 may be connected to the second base resistance R2. The collector of the second switching unit Q2 may be connected to the emitter of the third switching unit Q3, the anode of the first white light emitting device LED1 and the cathode of a second white light emitting device LED2.

The base of the third switching unit Q3 may be connected to the third base resistance R3. The collector of the third switching unit Q3 may be connected to the emitter of the fourth switching unit Q4, the anode of the second white light emitting device LED2 and the cathode of a third white light emitting device LED3.

The base of the fourth switching unit Q4 may be connected to the fourth base resistance R4. The collector of the fourth switching unit Q4 may be connected to the anode of the third white light emitting device LED3 and the cathode of the colored light emitter 310.

Meanwhile, the light emitter 300 may include the colored light emitter 310 and the white light emitter 320. The colored light emitter 310 may be a red light emitter, a blue light emitter, a green light emitter, a yellow light emitter or an amber light emitter. However, there is no limit to this.

As shown in FIG. 4, the white light emitter 320 may include three white light emitting devices LED1, LED2, and LED3 connected in series to each other. The three white light emitting devices LED1, LED2, and LED3 may be high voltage white light emitting device packages. The three white light emitting devices LED1, LED2, and LED3 are controlled respectively by the controller 200. Since the high voltage white light emitting device package can be used by controlling a voltage level without a separate AC-DC conversion after rectifying a commercial AC voltage, the high voltage white light emitting device package is advantageous for implementing a power circuit module for driving a light emitting device.

The colored light emitter 310 may include three colored light emitting devices LED4, LED5, and LED6 connected in series to each other. The three colored light emitting devices LED4, LED5, and LED6 may be connected in series to each other.

Hereafter, how the light emitting device driving module implements a high color rendering index in accordance with the embodiment will be described.

FIGS. 5*a* to 5*d* are circuit diagrams showing a current flow of a light emitter of the light emitting device driving module according to the embodiment.

For example, it is assumed that the forward threshold voltage of the light emitting device is 3V and the amplitude of the rectified voltage (Vrect) is 24V. When an area where all the light emitting devices LED1 to LED6 of the light emitting device driving module 1 become an off-state is designated as a first area, the rectified voltage (Vrect) of the first area is less than 9V. Therefore, the colored light emitter 310 becomes the off-state, so that all the light emitting devices maintain the off-state.

Figure 5A:
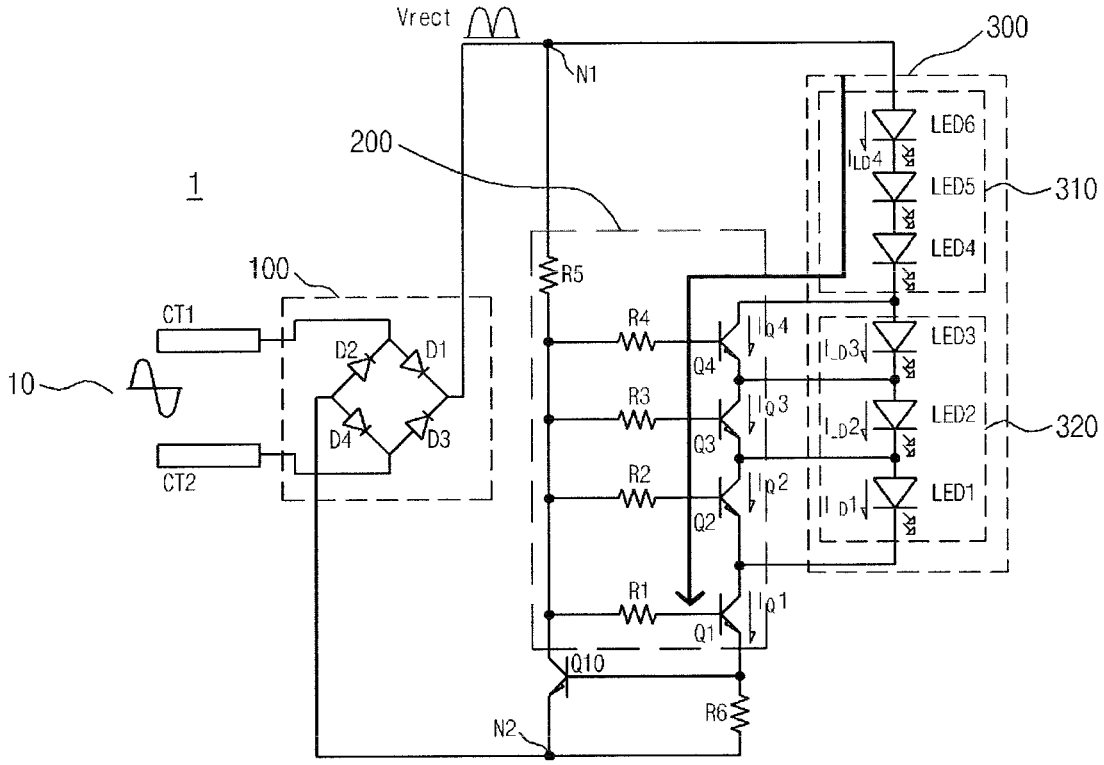
FIGS. 5*a* to 5*d* are circuit diagrams showing a current flow of a light emitter of the light emitting device driving module according to the embodiment.

Next, it is assumed that an area where the colored light emitter 310 is in an on-state and the white light emitter 320 is in the off-state is designated as a second area. In this case, the rectified voltage (Vrect) of the second area is greater than 9V and less than 12V. As shown in FIG. 5*a*, the current flows through the light emitter 300 in such a manner as to flow through the colored light emitting devices LED6, LED5, and LED4 of the colored light emitter 310 and then to flow through the fourth switching unit Q4, the third switching unit Q3, the second switching unit Q2, and the first switching unit Q1 of the controller 200. The current which has flowed through the controller 200 returns to the rectifier 100. Therefore, the colored light emitting devices LED4, LED5, and LED6 of the colored light emitter 310 become the on-state. Here, the current flowing through the controller 200 and the light emitter 300 satisfies the following equation (1).

$$IQ1=IQ2=IQ3=IQ4+ILD3=ILD4 \quad \text{equation (1)}$$

Here, IQ1, IQ2, IQ3, and IQ4 represent the current flowing from the collectors to the emitters of the first to the fourth switching units Q1 to Q4. ILD1, ILD2, ILD3, and ILD4 represent the current flowing through the first to the fourth light emitting devices LED1 to LED4.

Figure 5B:
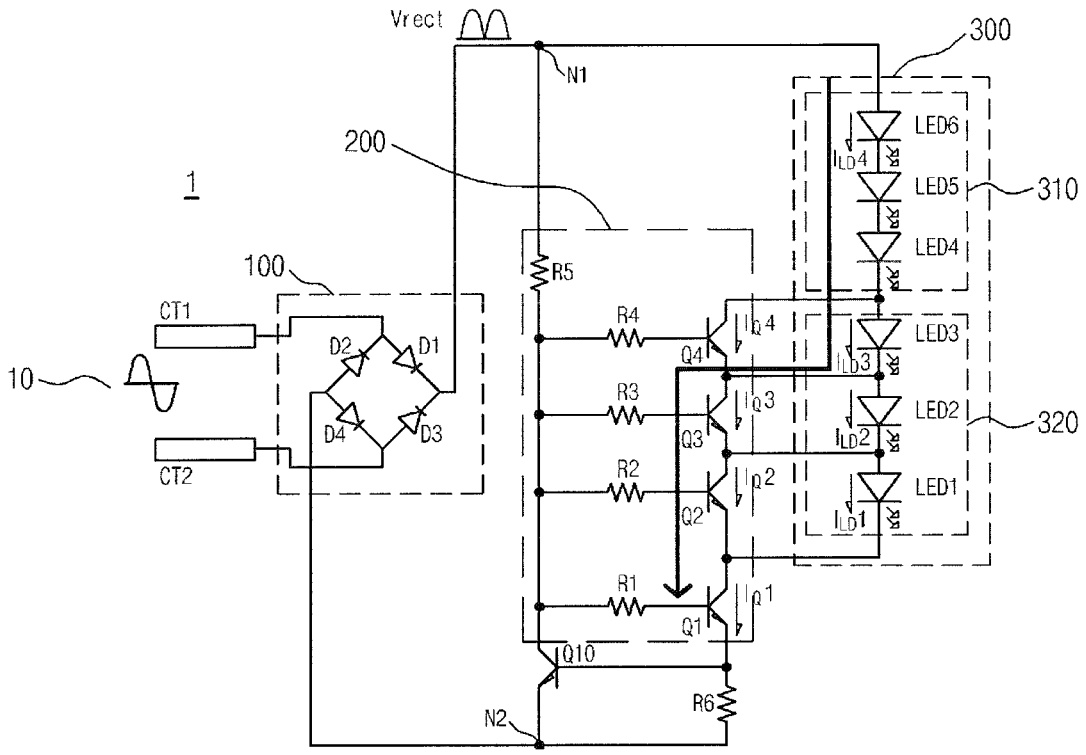

Next, it is assumed that an area where the colored light emitter 310 is in the on-state and only the third white light emitting device LED3 of the white light emitter 320 is in the on-state is designated as a third area. In this case, the rectified voltage (Vrect) of the third area is greater than 12V and less than 15V. As shown in FIG. 5*b*, the current flows through the light emitter 300 in such a manner as to flow through the colored light emitting devices LED6, LED5, and LED4 of the colored light emitter 310 and to flow through the third white light emitting device LED3 of the white light emitter 320, and then to flow through the third switching unit Q3, the second switching unit Q2, and the first switching unit Q1. The current which has flowed through the controller 200 returns to the rectifier 100. Therefore, the colored light emitter 310 and the third white light emitting device LED3 become the on-state. Here, the current flowing through the controller 200 and the light emitter 300 satisfies the following equation (2).

$$IQ1=IQ2=IQ3+ILD2=ILD3=ILD4 \quad \text{equation (2)}$$

Figure 5C:
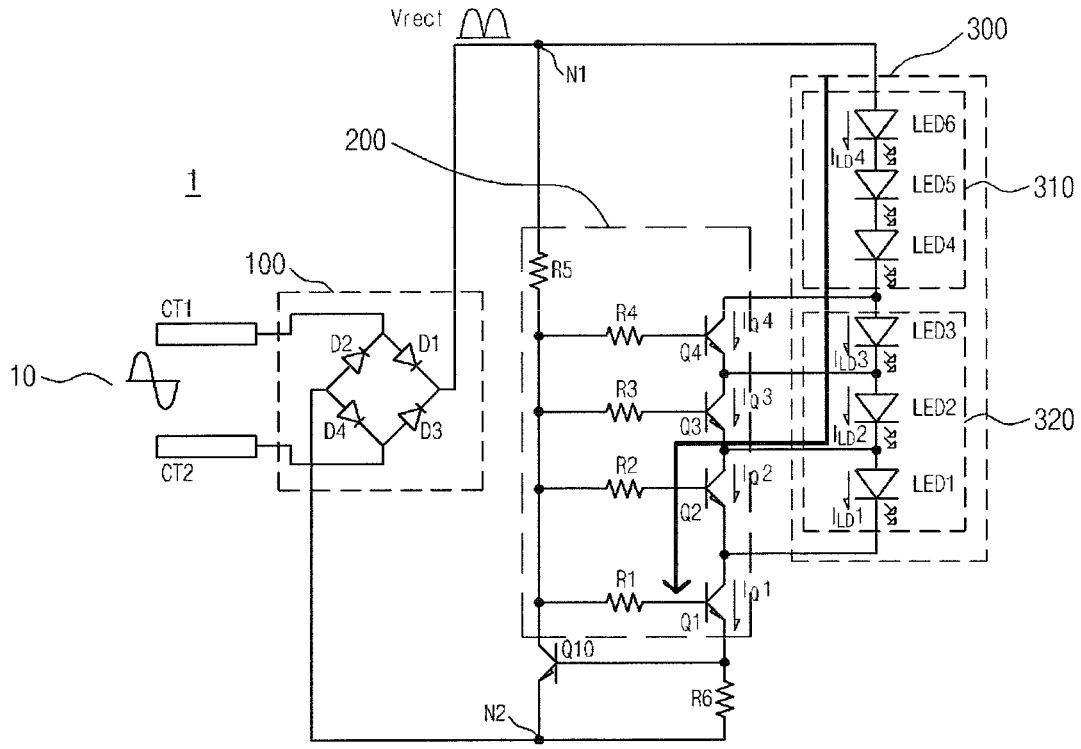

Next, it is assumed that an area where the colored light emitter 310 is in the on-state and the second white light emitting device LED2 and the third white light emitting device LED3 of the white light emitter 320 are in the on-state is designated as a fourth area. In this case, the rectified voltage (Vrect) of the fourth area is greater than 15V and less than 18V. As shown in FIG. 5*c*, the current flows through the light emitter 300 in such a manner as to flow through the colored light emitting devices LED6, LED5, and LED4 of the colored light emitter 310 and to flow through the third white light emitting device LED3 and the second white light emitting device LED2 of the white light emitter 320, and then to flow through the second switching unit Q2 and the first switching unit Q1. The current which has flowed through the controller 200 returns to the rectifier 100. Therefore, the colored light emitter 310, the third white light emitting device LED3 and the second white light emitting device LED2 become the on-state. Here, the current flowing through the controller 200 and the light emitter 300 satisfies the following equation (3).

$$IQ1=IQ2+ILD1=ILD2=ILD3=ILD4 \quad \text{equation (3)}$$

Figure 5D:
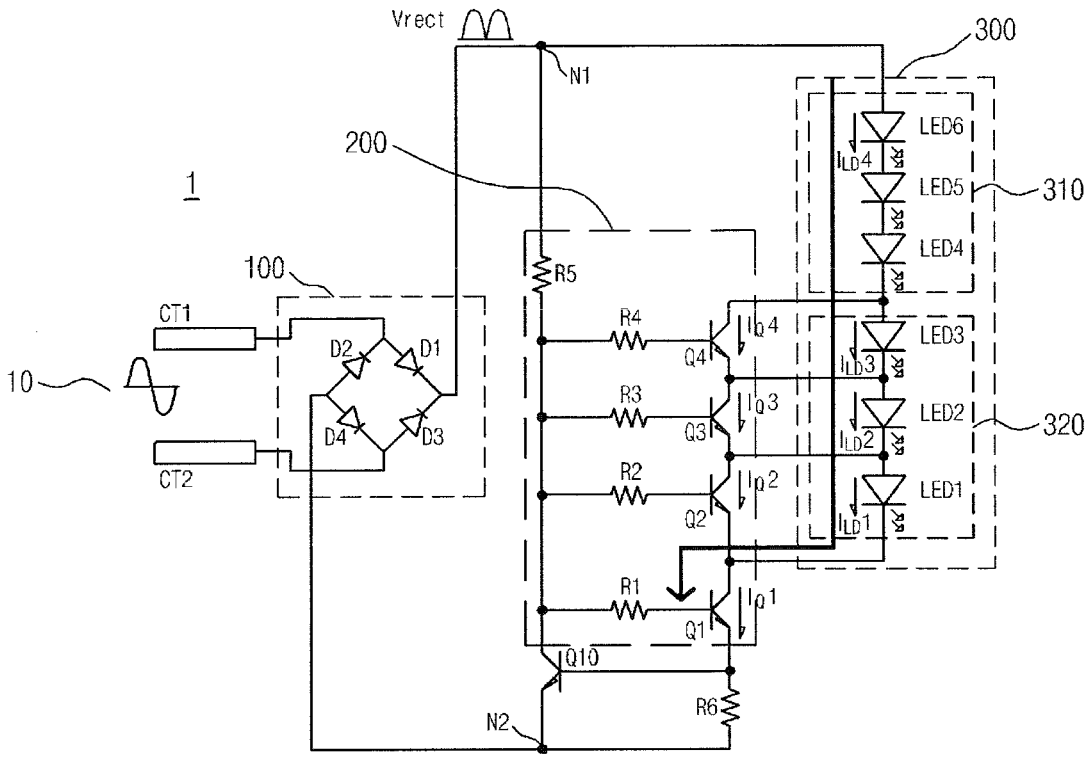

Lastly, it is assumed that an area where the colored light emitter 310 and all the light emitting devices of the white light emitter 320 are in the on-state is designated as a fifth area. In this case, the rectified voltage (Vrect) of the fifth area is more increased and is greater than 18V and less than 24V. As shown in FIG. 5*d*, the current flows through the light emitter 300 in such a manner as to flow through the colored light emitting devices LED6, LED5, and LED4 of the colored light emitter 310 and to flow through the third white light emitting device LED3, the second white light emitting device LED2 and the first white light emitting device LED1 of the white light emitter 320, and then to flow through the first switching unit Q1. The current which has flowed through the controller 200 returns to the rectifier 100. Therefore, the colored light emitter 310 and all the light emitting devices LED1 to LED6 of the white light emitter 320 become the on-state. Here, the current flowing through the controller 200 and the light emitter 300 satisfies the following equation (4).

$$IQ1=ILD1=ILD2=ILD3=ILD4 \quad \text{equation (4)}$$

As described above, depending on the magnitude of the rectified voltage (Vrect), the controller 200 is able to control the on/offs of the light emitting devices LED1 to LED6 of the light emitter 300.

Though it has been described in the embodiment that the colored light emitter 310 includes three colored light emitting devices and the white light emitter 320 includes three high voltage white light emitting device packages, there is no limit to this. For example, the colored light emitter 310 may include three or more colored light emitting devices and the white light emitter 320 may include four or more high voltage white light emitting device packages. A voltage relatively higher than that of the colored light emitting device may be applied to the high voltage white light emitting device package.

Depending on the magnitude of the rectified voltage (Vrect) which is applied to the light emitter 300 according to the embodiment, the number of the colored light emitting devices of the colored light emitter 310 and the number of the white light emitting devices of the white light emitter 320 may be changed.

Figure 6A:
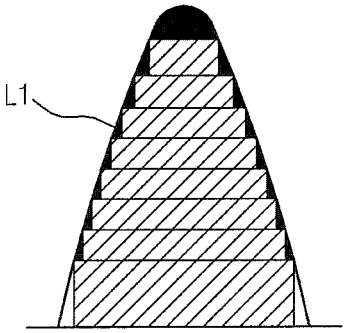
FIG. 6*a* is a graph showing power loss of the light emitting device driving module according to the embodiment.
Figure 6B:
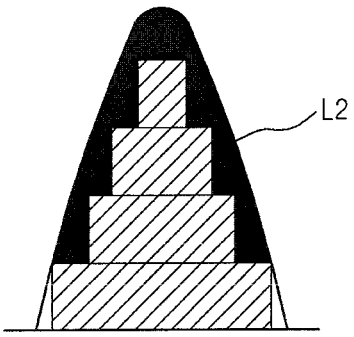
FIG. 6*b* is a graph showing power loss of the light emitter composed of a high voltage white light emitting device package.

FIG. 6*a* is a graph showing power loss of the light emitting device driving module according to the embodiment, and FIG. 6*b* is a graph showing power loss of the light emitter composed of the high voltage white light emitting device package.

The light emitter 300 of the light emitting device driving module 1 according to the embodiment includes the white light emitter 320 and the colored light emitter 310. Generally, the driving voltage of the high voltage white light emitting device package is relatively greater than that of the colored light emitting device. Therefore, in the light emitting device driving module 1 according to the embodiment, the white light emitter 320 includes at least one high voltage white light emitting device package and the colored light emitter 310 includes at least one colored light emitting device. Thus, when the rectified voltage (Vrect) is applied to the light emitter 300, the colored light emitting device of the colored light emitter 310 performs the on/off operation for a time period during which the high voltage white light emitting device package of the white light emitter 320 performs the on/off operation.

Accordingly, as shown in FIGS. 6*a* and 6*b*, the power loss L1 of the light emitting device driving module according to the embodiment is less than the power loss L2 of the light emitting device driving module including the light emitter composed of only the high voltage white light emitting device package.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light emitting device driving module comprising:

a light emitter comprising a first light emitter one or more second light emitters connected to the first light emitter;

a rectifier which receives an AC power and outputs a rectified voltage; and a controller which receives the rectified voltage from the rectifier and controls currents of the first light emitter and the one or more second light emitters in accordance with a magnitude of the rectified voltage, wherein the controller controls the currents of the first light emitter and the one or more second light emitters by comparing the rectified voltage with a threshold voltage of the light emitter, wherein, when the rectified voltage is greater than the threshold voltage of the first light emitter, the controller causes the first light emitter to be in an on-state, and wherein, when the rectified voltage is greater than a sum of the threshold voltage of the first light emitter and the threshold voltage of a predetermined number of the one or more second light emitters, the controller causes the predetermined number of the one or more second light emitters to be in an on-state.

2. The light emitting device driving module of claim 1, wherein the first light emitter is a red light emitter, and wherein the one or more second light emitters are white light emitters which are connected in series to the red light emitter.

3. The light emitting device driving module of claim 2, wherein the white light emitters comprise one or more high voltage white light emitting device packages, and wherein the one or more high voltage white light emitting device packages are independently and respectively controlled by the controller.

4. The light emitting device driving module of claim 2, wherein the red light emitter comprises one or more red light emitting devices, and wherein the one or more red light emitting devices are connected in series to each other.

5. The light emitting device driving module of claim 3, wherein the one or more high voltage white light emitting device packages are a first to a third high voltage white light emitting device packages, and wherein the first to the third high voltage white light emitting device packages are connected in series to each other.

6. The light emitting device driving module comprising:

a light emitter comprising a first light emitter and one or more second light emitters connected to the first light emitter;

a rectifier which receives an AC power and outputs a rectified voltage; and a controller which receives the rectified voltage from the rectifier and controls currents of the first light emitter and the one or more second light emitters in accordance with a magnitude of the rectified voltage, wherein the one or more second light emitters comprise a first light emitting device package, second light emitting device package and third light emitting device package, wherein the first light emitting device package, second light emitting device package and third light emitting device package are connected in series to each other, and wherein the controller comprises:

a first switching unit which controls the current of the entire light emitter; and a second switching unit, a third switching unit and a fourth switching unit which control the currents of the first light emitting device package, second light emitting device package and third light emitting device package, respectively.

7. The light emitting device driving module of claim 6, wherein the first to the fourth switching units comprise a bipolar junction transistor (BJT).

8. A light emitting device driving module comprising:

a rectifier which rectifies an AC power and outputs a rectified voltage;

a first light emitter which receives the rectified voltage and comprises a plurality of first LEDs;

a second light emitter which is directly connected to the first light emitter and comprises a plurality of second LEDs; and a controller which comprises a plurality of switching units which are connected between the second light emitter and a ground (GND), is turned on by the rectified voltage, and electrically connects an anode of a corresponding second LED with the ground, wherein the plurality of switching units are turned on by the rectified voltage, wherein the plurality of second LEDs comprises a first LED package, a second LED package, and a third LED package, and wherein the plurality of switching units comprise a first switching unit, a second switching unit, a third switching unit and a fourth switching unit.

9. The light emitting device driving module of claim 8, wherein each of the first LEDs is a colored LED which emits colored light, and wherein each of the second LEDs is a high voltage white LED package which emits white light.

10. The light emitting device driving module of claim 9, wherein the first LED comprises any one of a red LED which has a light emitting peak wavelength of from 600 nm to 650 nm in a red region, a green LED which has a light emitting peak wavelength of from 520 nm to 570 nm in a green region, a blue LED which has a light emitting peak wavelength of from 430 nm to 490 nm in a blue region, and an amber LED which has a light emitting peak wavelength of from 570 nm to 620 nm in an amber region.

11. The light emitting device driving module of claim 9, wherein the high voltage white LED package comprises a blue LED and a yellow phosphor.

12. The light emitting device driving module of claim 9, wherein the first LEDs are connected in series to a plurality of red LEDs, and wherein the second LEDs are connected in series to a plurality of the high voltage white LED packages.

13. The light emitting device driving module of claim 12, wherein the plurality of the switching units connects the ground with the anode of each of the plurality of high voltage white LED packages.

14. The light emitting device driving module of claim 8, wherein the first to the fourth switching units are bipolar junction transistors (BJT).

15. The light emitting device driving module of claim 14, wherein an emitter of the first switching unit is connected to the ground, a base of the first switching unit is connected to an end of a first resistance, and a collector of the first switching unit is connected to an emitter of the second switching unit and a cathode of the first high voltage white LED package, wherein a base of the second switching unit is connected to an end of a second resistance and a collector of the second switching unit is connected to an emitter of the third switching unit and the anode of the first high voltage white LED package, wherein a base of the third switching unit is connected to an end of a third resistance and a collector of the third switching unit is connected to an emitter of the fourth switching unit and the anode of the second high voltage white LED package, wherein a base of the fourth switching unit is connected to an end of a fourth resistance and a collector of the fourth switching unit is connected to the anode of the third high voltage white LED package, and wherein the other ends of the first to the fourth resistances are connected to an output terminal of the rectifier.

16. The light emitting device driving module of claim 8, wherein the rectifier is a bridge rectifier circuit.

17. The light emitting device driving module of claim 6, wherein the first light emitter is a red light emitter, and wherein the second light emitters are white light emitters which are connected in series to the red light emitter.

18. The light emitting device driving module of claim 6, wherein the first light emitting device package, second light emitting device package and third light emitting device package are high voltage white light emitting device packages, and wherein first light emitting device package, second light emitting device package and third light emitting device package are independently and respectively controlled by the controller.

* * * * *